US008281963B2

(12) United States Patent
Liu

(10) Patent No.: US 8,281,963 B2
(45) Date of Patent: Oct. 9, 2012

(54) DISPENSING APPARATUS

(75) Inventor: Da-Wei Liu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 415 days.

(21) Appl. No.: 12/700,911

(22) Filed: Feb. 5, 2010

(65) Prior Publication Data

US 2011/0095056 A1 Apr. 28, 2011

(30) Foreign Application Priority Data

Oct. 26, 2009 (CN) ..... 2009 1 0308833

(51) Int. Cl.
*B65D 47/00* (2006.01)

(52) U.S. Cl. ..... 222/504; 222/181.2; 222/547; 222/559

(58) Field of Classification Search ..... 222/180, 222/181.1, 181.2, 181.3, 504, 559, 571, 547; 251/122
See application file for complete search history.

(56) References Cited

U.S. PATENT DOCUMENTS

| | | | | |
|---|---|---|---|---|
| 5,137,187 | A * | 8/1992 | Nichols et al. | 222/504 |
| 5,788,128 | A * | 8/1998 | Hickey | 222/504 |
| 6,089,413 | A * | 7/2000 | Riney et al. | 222/318 |
| 6,443,335 | B1 * | 9/2002 | Pinedjian et al. | 222/504 |
| 7,052,549 | B2 * | 5/2006 | Chambers et al. | 118/313 |
| 2003/0155384 | A1 * | 8/2003 | Nagahata et al. | 222/504 |
| 2005/0224513 | A1 * | 10/2005 | Strong et al. | 222/1 |
| 2005/0242313 | A1 * | 11/2005 | Kronholm | 251/124 |
| 2006/0108383 | A1 * | 5/2006 | Byerly | 222/504 |
| 2006/0124672 | A1 * | 6/2006 | Penalver Garcia | 222/504 |
| 2006/0157517 | A1 * | 7/2006 | Fiske et al. | 222/504 |
| 2007/0113924 | A1 * | 5/2007 | Phillips, Jr. | 141/351 |
| 2009/0095825 | A1 * | 4/2009 | Ahmadi et al. | 239/583 |
| 2009/0166386 | A1 * | 7/2009 | Morand | 222/559 |
| 2009/0242590 | A1 * | 10/2009 | Saveliev et al. | 222/509 |

FOREIGN PATENT DOCUMENTS

| | | |
|---|---|---|
| CN | 201135955 Y | 10/2008 |
| CN | 201205533 Y | 3/2009 |

* cited by examiner

*Primary Examiner* — Kevin P Shaver
*Assistant Examiner* — Patrick M Buechner
(74) *Attorney, Agent, or Firm* — Altis Law Group, Inc.

(57) ABSTRACT

A dispensing apparatus includes a mounting plate and a dispenser fixed to the mounting plate. The dispenser includes a nozzle valve, a valve plug, an actuating shaft, and a nozzle. The nozzle valve defines a cavity containing a material, and defines an inlet opening on a sidewall thereof to communicate with the cavity. The valve plug is disposed in the cavity. The actuating shaft extends through an end of the nozzle valve, and is connected to the valve plug. The nozzle is disposed at the other end of the nozzle valve facing the actuating shaft. The actuating shaft moves the valve plug away from or closer to the nozzle so as to close or open the inlet opening.

12 Claims, 8 Drawing Sheets

DISPENSING APPARATUS

BACKGROUND

1. Technical Field

The present disclosure relates generally to material dispensation, and especially to a dispensing apparatus for glue.

2. Description of Related Art

Dispensing apparatuses are commonly used for the application of glue or other material onto a workpiece. The dispensing apparatus often includes a nozzle valve for controlling the supply of material, and a nozzle connected to the nozzle valve for dispensing material. However, a small volume of material can escape through the nozzle even after the nozzle valve is closed. Residual material can accumulate on the workpiece, requiring cleaning steps to be added to the process. Furthermore, maintenance of the dispensing apparatus is necessary.

One solution has been the use of a pneumatic controller connected to the nozzle valve. When the nozzle valve is closed, the pneumatic controller evacuates the air from the nozzle valve, thereby retracting existing material back into the apparatus. However, the inclusion of the pneumatic controller renders the dispensing apparatus bulky, complicated, and costly to manufacture.

Therefore, a dispensing apparatus which overcomes the described limitations is desired.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
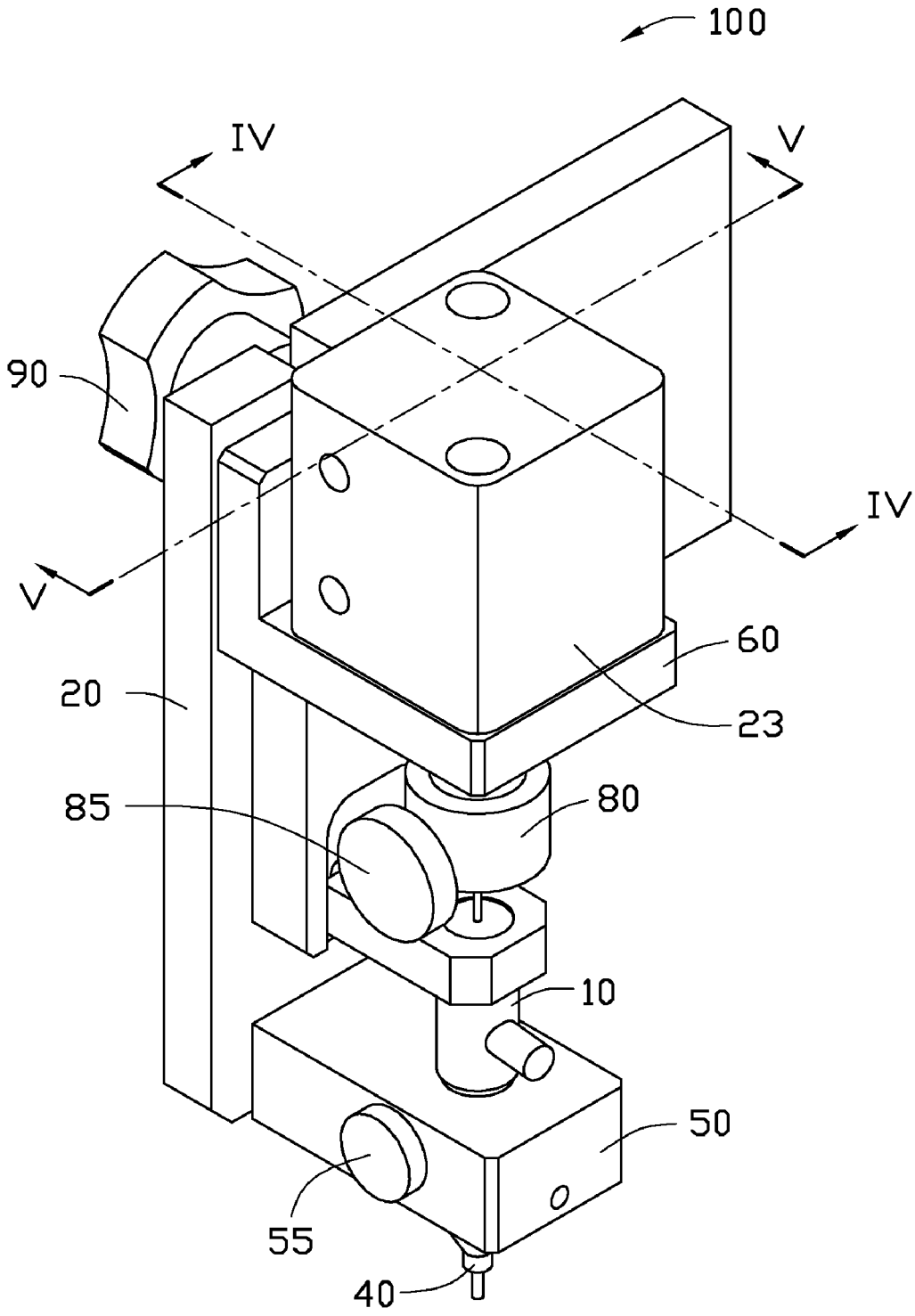
FIG. 1 is an assembled, isometric view of a first embodiment of a dispensing apparatus, which includes a dispenser.
Figure 2:
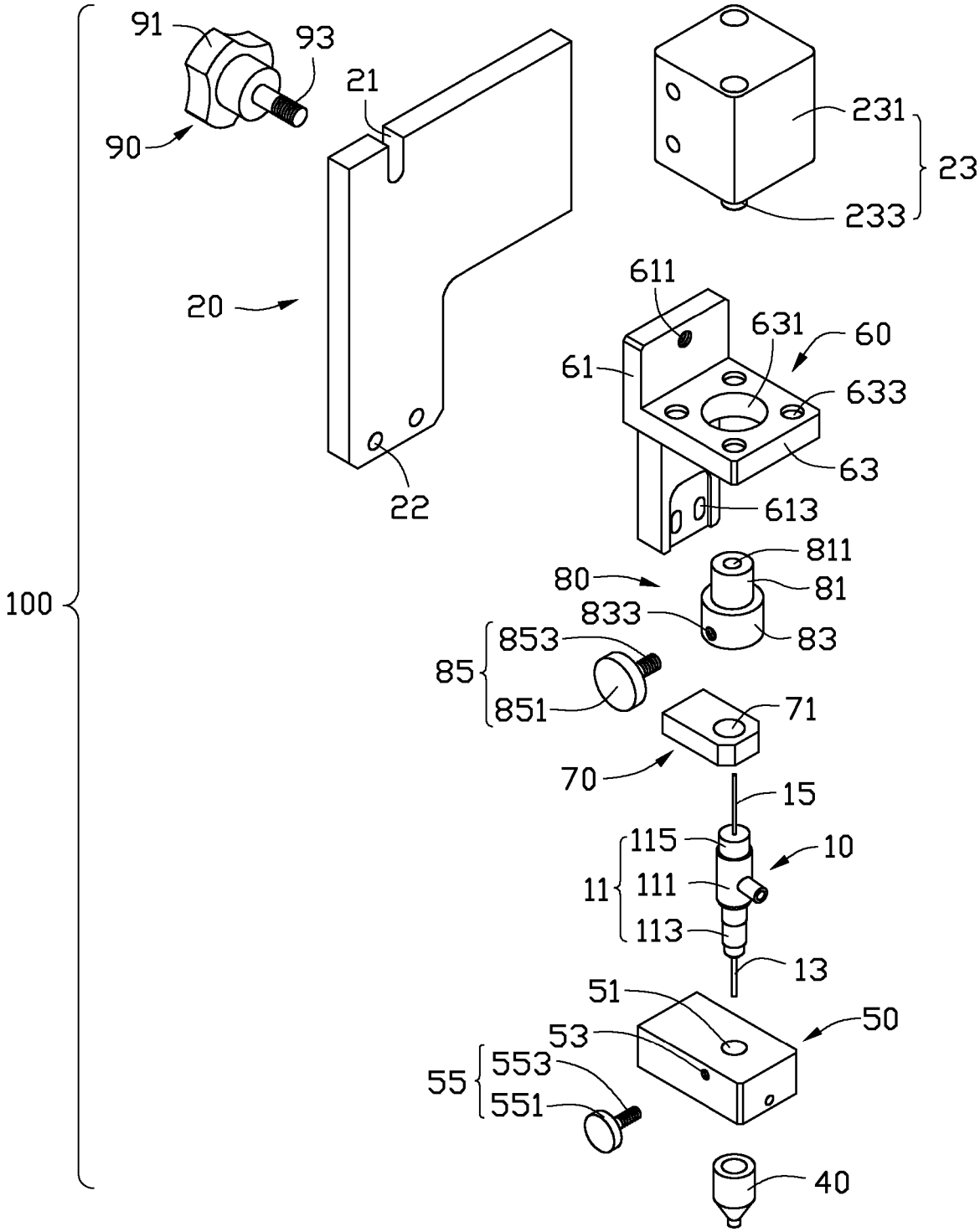
FIG. 2 is an exploded, isometric view of the dispensing apparatus of FIG. 1.

Referring to FIGS. 1 and 2, a first embodiment of a dispensing apparatus 100 includes a dispenser 10, a mounting plate 20, and a driving device 23. The dispenser 10 and the driving device 23 are fixed to the mounting plate 20. The driving device 23 is configured to drive the dispenser 10.

Figure 3:
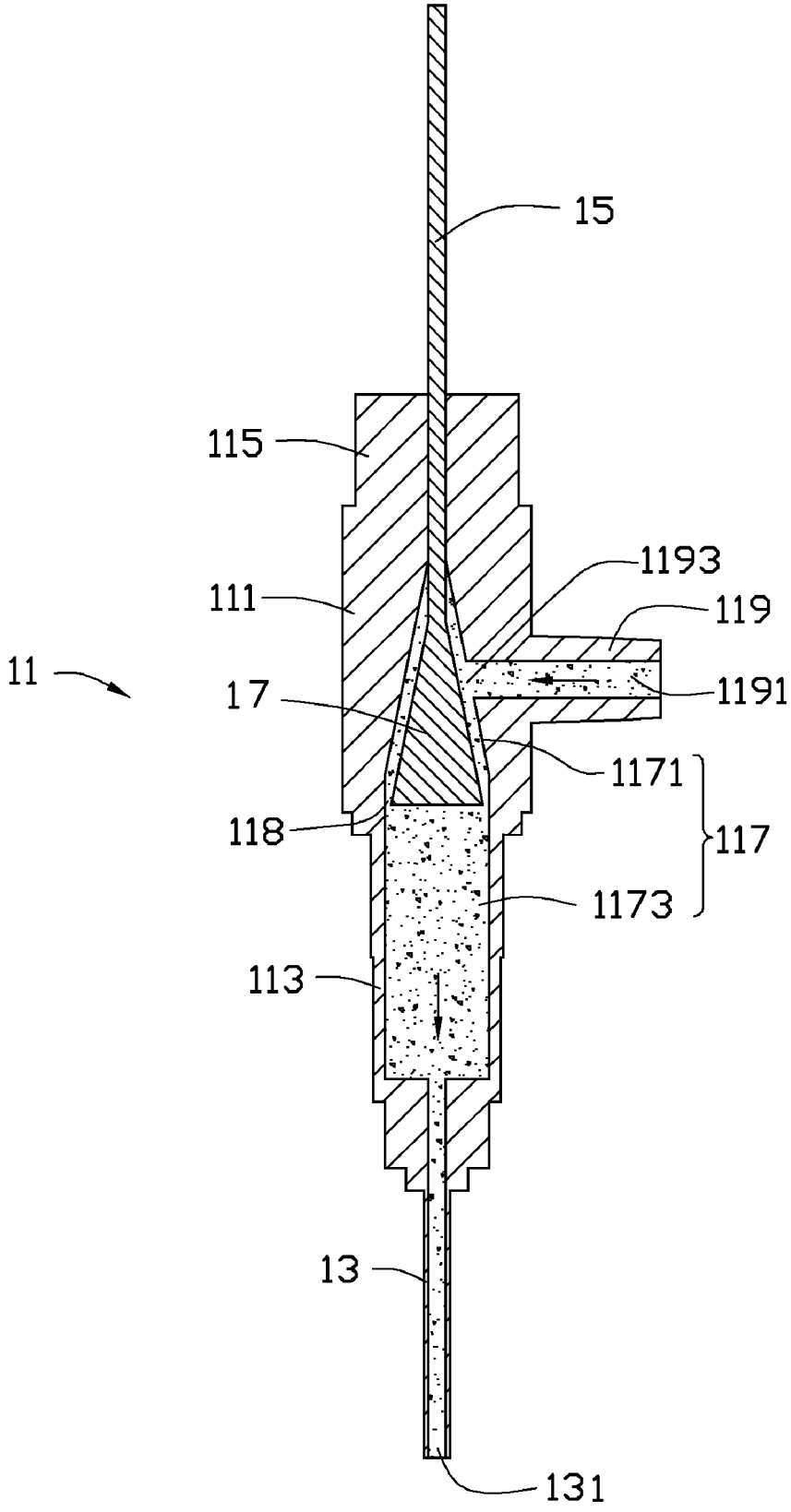
FIG. 3 is an enlarged, cutaway view of the dispenser of FIG. 1, the dispenser including a valve plug.

Referring to FIG. 3, the dispenser 10 includes a nozzle valve 11, a nozzle 13, an actuating shaft 15, and a valve plug 17. The nozzle valve 11 may be a substantially hollow cylinder, and includes a main body 111, and a first latching portion 113 and a second latching portion 115 formed at the opposite ends of the main body 111. The nozzle valve 11 defines a cavity 117. The cavity 117 includes a first receiving portion 1171 defined in the main body 111 and a second receiving portion 1173 defined in the first latching portion 113 communicating with the first receiving portion 1171. The first receiving portion 1171 is substantially conical with a gradually increasing diameter from an upper end to a lower end thereof. The second receiving portion 1173 is substantially cylindrical. The nozzle valve 11 further includes an inlet tube 119 formed on a side surface of the main body 111. The nozzle valve 11 defines an inlet opening 1193 on a sidewall of the first receiving portion 1171. The inlet tube 119 defines a channel 1191 communicating with the inlet opening 1193.

The nozzle 13 may be a substantially thin hollow tube connected to one end of the first latching portion 113. The nozzle 13 defines an outlet opening 131 at an end of the nozzle 13 communicating with the second receiving portion 1173.

The valve plug 17 is located inside the cavity 117 of the nozzle valve 11. The valve plug 17 is shaped similar to the first receiving portion 1171, also with a gradually increasing width towards the nozzle 13. At its widest width, the width of the valve plug 17 is narrower than a diameter of the second receiving portion 1173, such that an annular gap 118 is defined between an end of valve plug 17 and the sidewall of the second receiving portion 1173 Materials such as glue can flow from the first receiving portion 1171 to the second receiving portion 1173 through the gap 118.

A lower end of the actuating shaft 15 extends through the second latching portion 115 of the nozzle valve 11, and the actuating shaft 15 is fixed to the valve plug 17, enabling the actuating shaft 15 to drive the valve plug 17 away from or closer to the nozzle 13.

Referring to FIG. 2 again, the mounting plate 20 is substantially an L-shaped plate. The mounting plate 20 defines a latching groove 21 at a top surface, and defines two fixing holes 22 adjacent to a lower portion of the mounting plate 20. In the first embodiment, the driving device 23 is a pneumatic cylinder, and includes a cylinder body 231 and a piston shaft 233, and the piston shaft 233 is movably connected to the cylinder body 231.

The dispensing apparatus 100 further includes a nozzle sleeve 40 configured to protect the nozzle 13, a first fixing member 50 configured to fix the nozzle sleeve 40 to the mounting plate 20, and a first fastening member 55 configured to fix the dispenser 10 to the first fixing member 50.

Figure 4:
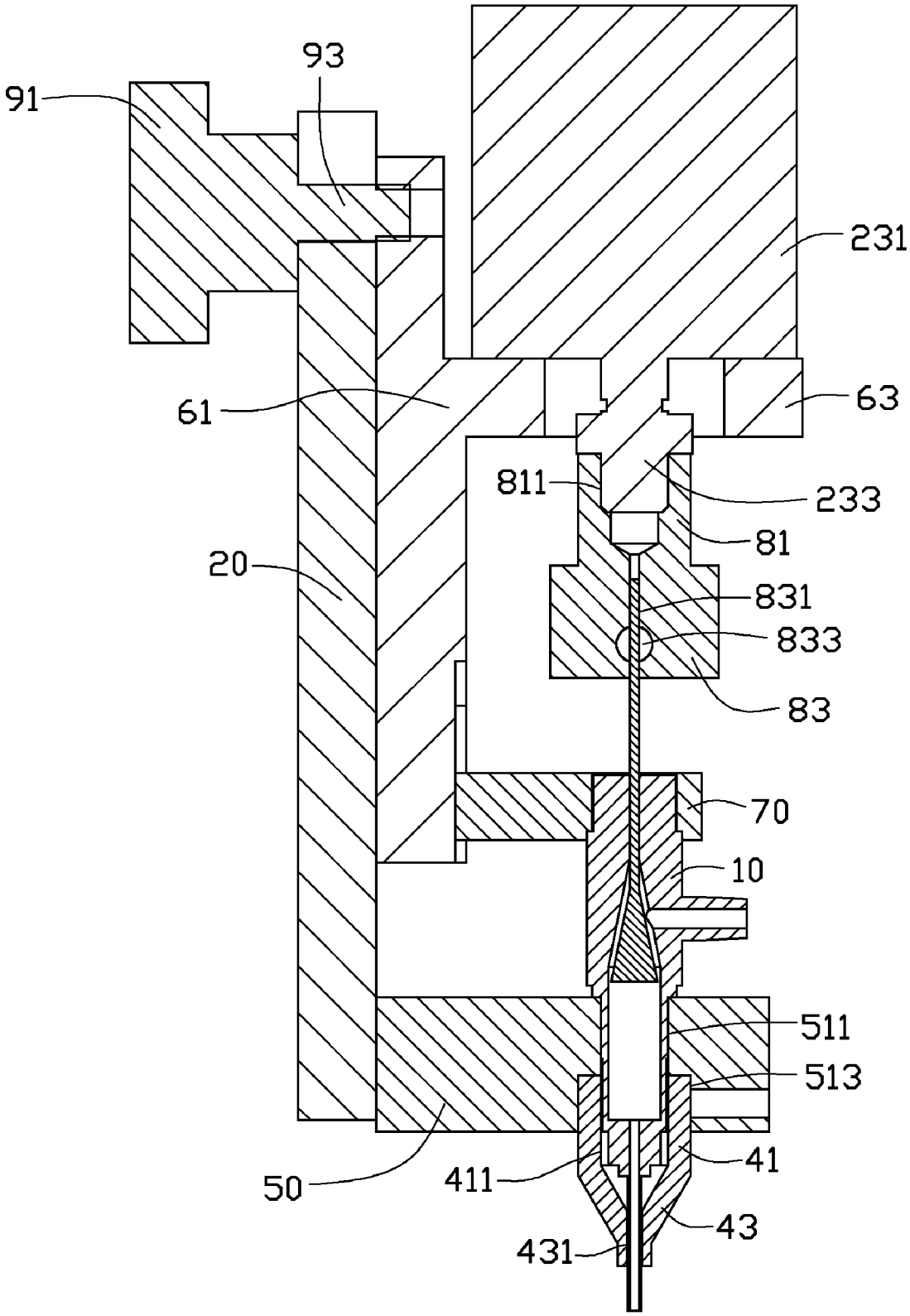
FIG. 4 is a cross-section of the dispensing apparatus taken along line IV-IV of FIG. 1.
Figure 5:
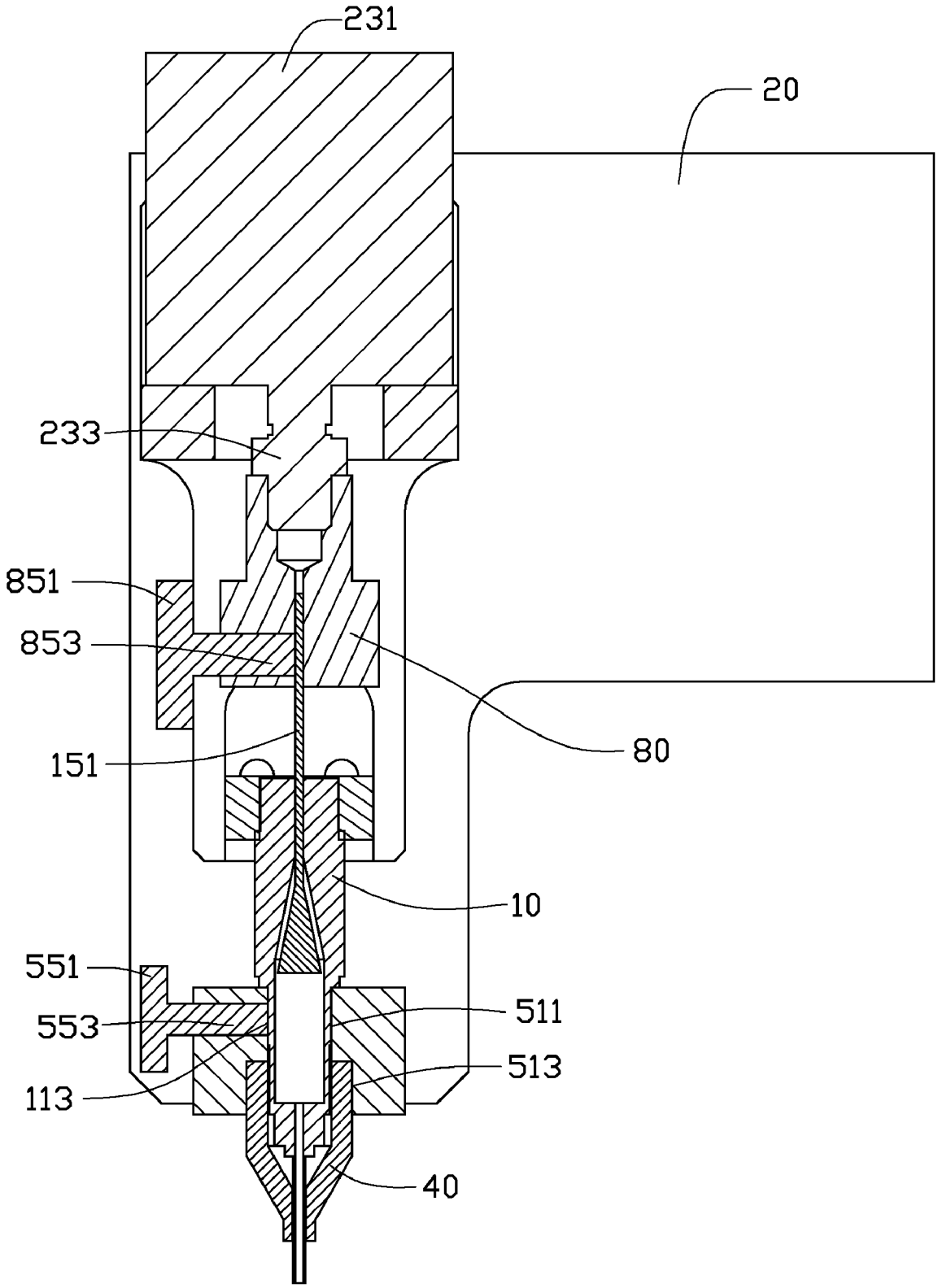
FIG. 5 is a cross-section of the dispensing apparatus taken along line V-V of FIG. 1.

Referring to FIGS. 4 and 5, the nozzle sleeve 40 includes a fixing portion 41, which is substantially cylindrical, and a protecting portion 43, which is substantially tapered, connected thereto. The fixing portion 41 defines a receiving groove 411 to receive the first latching portion 113 of the nozzle valve 11. The protecting portion 43 defines a through hole 431 to receive the nozzle 13.

The first fixing member 50 is substantially rectangular, and is fixed to the mounting plate 20 by two fasteners (not shown) received in the corresponding two fixing holes 22. The first fixing member 50 defines a through hole 51 in a middle portion of the first fixing member 50. The through hole 51 includes a first holding portion 511 to receive the first latching portion 113 of the nozzle valve 11, and a second holding portion 513 to receive the fixing portion 41 of the nozzle sleeve 40. The first fixing member 50 further defines a threaded hole 53 on a side surface of the first fixing member 50 communicating with the first holding portion 511. The first fastening member 55 includes a disk-shaped operating portion 551 and a threaded portion 553 connected to the operating portion 551, and the threaded portion 553 is received in the threaded hole 53.

Referring to FIG. 2 again, the dispensing apparatus 100 further includes a supporting member 60, a second fixing member 70, a connecting sleeve 80, a second fastening member 85, and a third fastening member 90.

The supporting member 60 includes a base 61 and a supporting board 63 extending from a middle portion of the base 61. The base 61 defines a threaded hole 611 adjacent to a top end of the base 61, and defines two fixing holes 613 adjacent to a lower end of the base 61. The supporting board 63 defines a through hole 631 in a middle portion to receive the piston shaft 233 of the driving device 23. The supporting board 63 further defines four fixing holes 633 arranged along a circumference of the through hole 631. The cylinder body 231 of the driving device 23 is fixed to the supporting board 63 by four fasteners (not shown) received in the corresponding four fixing holes 633.

The second fixing member 70 is substantially rectangular, and is fixed to the base 61 by two fasteners (not shown) received in the corresponding two fixing holes 613. The second fixing member 70 defines a through hole 71 to receive the second latching portion 115 of the nozzle valve 11.

Referring also to FIG. 4, the connecting sleeve 80 includes a first connecting portion 81 and a second connecting portion 83 connected to the first connecting portion 81. The first connecting portion 81 defines a first latching cavity 811 to receive the piston shaft 233 of the driving device 23. The second connecting portion 83 defines a second latching cavity 831 communicating with the first latching cavity 811 to receive the actuating shaft 15. The second connecting portion 83 further defines a threaded hole 833 on a side surface of the second connecting portion 83 communicating with the second latching cavity 831.

The second fastening member 85 is similar to the first fastening member 55, and includes an operating portion 851, which is disk-shaped, and a threaded portion 853 connected to the operating portion 851 received in the threaded hole 833.

The third fastening member 90 includes an operating portion 91, which is substantially triangular, and a threaded portion 93 connected to the operation portion 91. The threaded portion 93 can pass through the latching groove 21 of the mounting plate 20 and be received in the threaded hole 611 of the supporting member 60.

Referring to FIGS. 1 through 5, during assembly of the dispensing apparatus 100, the driving device 23 and the second fixing member 70 are fixed to the supporting member 60. The piston shaft 233 is received and fixed inside the first latching cavity 811 of the connecting sleeve 80. The fixing portion 41 of the nozzle sleeve 40 is received and fixed inside the second holding portion 513 of the first fixing member 50. The first fixing member 50 is fixed to the mounting plate 20.

The actuating shaft 15 of the dispenser 10 passes through the through hole 71 of the second fixing member 70, and is located inside the second latching cavity 831. The operating portion 851 of the second fastening member 85 is rotated, such that the threaded portion 853 is received in the threaded hole 833 of the second connecting portion 83 and abuts the actuating shaft 15. Therefore, the actuating shaft 15 is firmly fixed to the piston shaft 233 of the driving device 23 via the connecting sleeve 80; and the driving device 23 is capable of moving the actuating shaft 15 and the valve plug 17 upward or downward relative to the nozzle valve 11.

The threaded portion 93 of the third fastening member 90 passes through the latching groove 21 of the mounting plate 20 and is received in the threaded hole 611 of the supporting member 60, such that the supporting member 60, as well as the dispenser 10 and the driving device 23 fixed to the supporting member 60, are fixed to the mounting plate 20. The first latching portion 113 of the nozzle valve 11 latches inside the first holding portion 511 of the first fixing member 50, and the nozzle 13 passes through the through hole 431 protruding from the nozzle sleeve 40. The operating portion 551 of the first fastening member 55 is rotated, such that the threaded portion 553 passes through the threaded hole 53 and abuts the first latching portion 113 of the nozzle valve 11. Thus, the dispenser 10 is firmly fixed between the first fixing member 50 and the second fixing member 70. Assembly of the dispensing apparatus 100 is then complete.

Referring to FIG. 3 again, in use, the dispenser 10 is filled with material discharged from the inlet tube 119. When the dispenser 10 is turned on, the valve plug 17 of the dispenser 10 is positioned between the first receiving portion 1171 and the second receiving portion 1173 and opens the inlet opening 1193. Material can be discharged from the inlet tube 119 to the first receiving portion 1171, and then flowed to the second receiving portion 1173 through the gap 118, and is dispensed through the outlet opening 131 of the nozzle 13.

Figure 6:
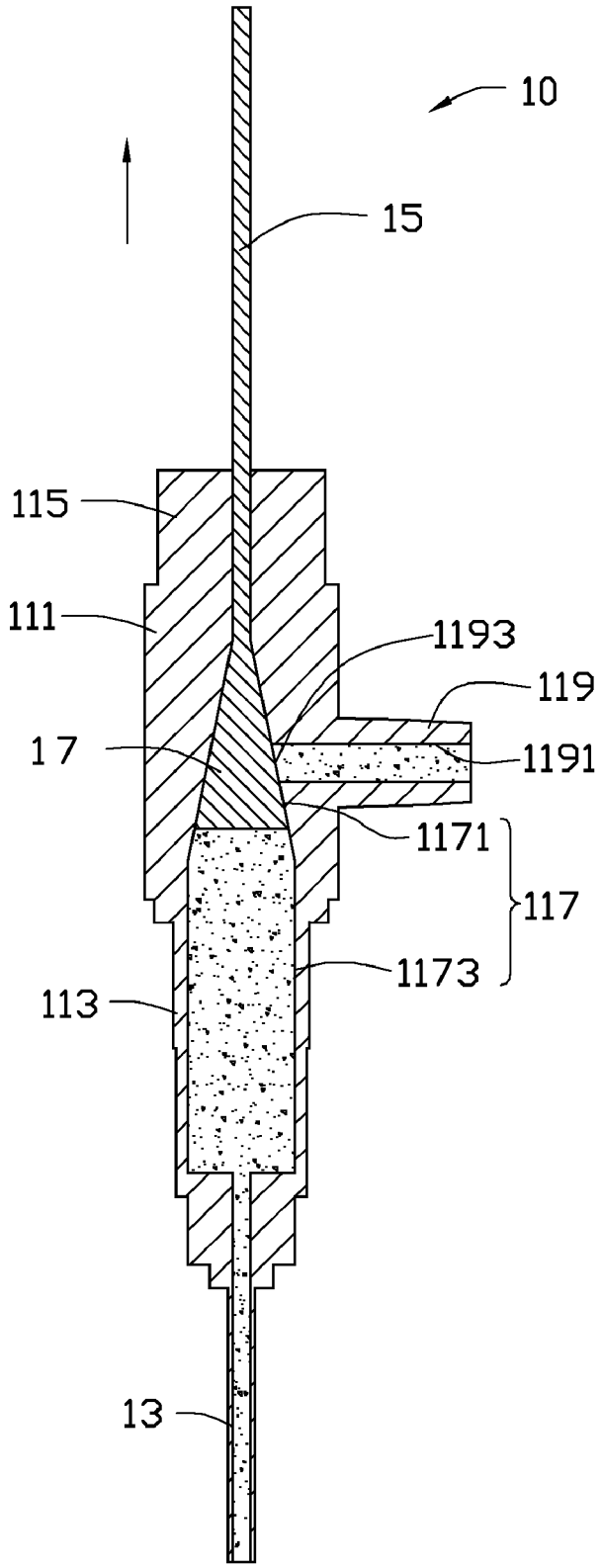
FIG. 6 is similar to FIG. 3, but shows the valve plug in another position.

Referring also to FIG. 6, when the dispenser 10 is to be turned off (closed), the actuating shaft 15 is moved immediately upward by the piston shaft 233 of the driving device 23, such that the valve plug 17 moves away from the nozzle 13 and enters the first receiving portion 1171 entirely. Then the valve plug 17 abuts a sidewall of first receiving portion 1171 and seals the inlet opening 1193. When the valve plug 17 moves upwards, a small volume of material is pushed back to the channel 1191 of the inlet tube 119, such that a lowered hydraulic pressure is provided to the material in the second receiving portion 1173, and the material inside the outlet opening 131 is retracted to the nozzle 13, and a clean cut off is provided. The dispenser 10 can easily return to the turned on/open state again by driving the valve plug 17 near the nozzle 13 to open the inlet opening 1193.

Material inside the dispenser 10 may harden and jam the nozzle 13 over time, requiring replacement of the dispenser 10. During replacement, the operating portion 551 of the first fastening member 55 is rotated reversely to detach the threaded portion 553 from the first latching portion 113 of the nozzle valve 11. The operating portion 91 of the third fastening member 90 is rotated reversely, such that the supporting member 60 is disassembled from the mounting plate 20, and the dispenser 10 is disassembled from the first fixing member 50. Finally, the operating portion 851 of the second fastening member 85 is rotated reversely to detach the threaded portion 853 from the actuating shaft 15. Thus, the dispenser 10 is disassembled from the second fixing member 70; and the dispenser 10 can be replaced.

Figure 7:
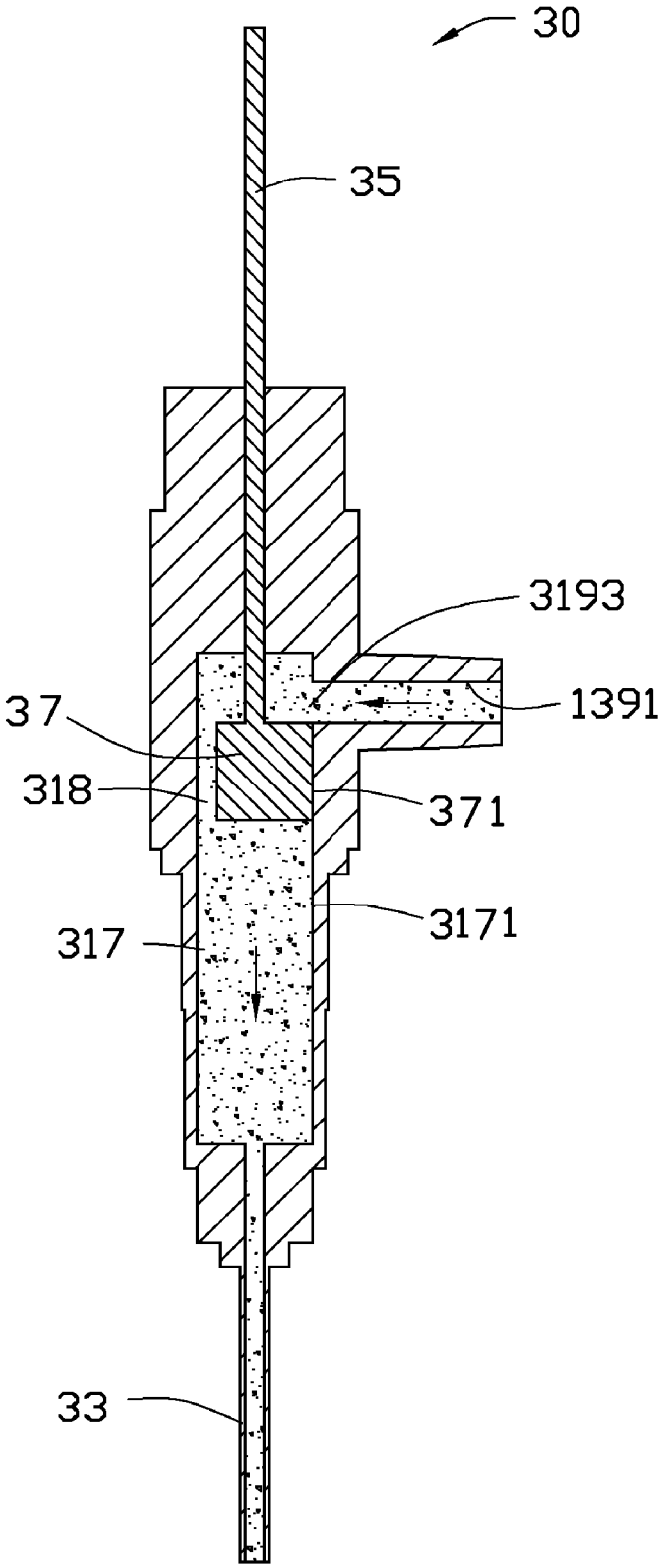
FIG. 7 is an enlarged, cutaway view of a second embodiment of a dispenser.

Referring to FIG. 7, a dispenser 30 in accordance with a second embodiment of the present invention is shown. The dispenser 30 differs from the dispenser 10 only in that the cavity 317 is substantially cylindrical, and the valve plug 37 is also substantially cylindrical, although with a circumference less than that of the cavity 317. A side surface 371 of the valve plug 37 facing the inlet opening 3193 contacts a sidewall 3171 of the cavity 317; and a gap 318 is defined between the other side surface of the valve plug 37 away from the inlet opening 3193 and the sidewall 3171 of the cavity 317. When the dispenser 30 is turned on (open state), the valve plug 37 is positioned in a middle portion of the cavity 317 and opens the inlet opening 3193. Material can be discharged from the channel 1391 to an upper portion of the cavity 317, then flowed to a lower portion of the cavity 317 through the gap 318, and finally be dispensed through the nozzle 33.

Figure 8:
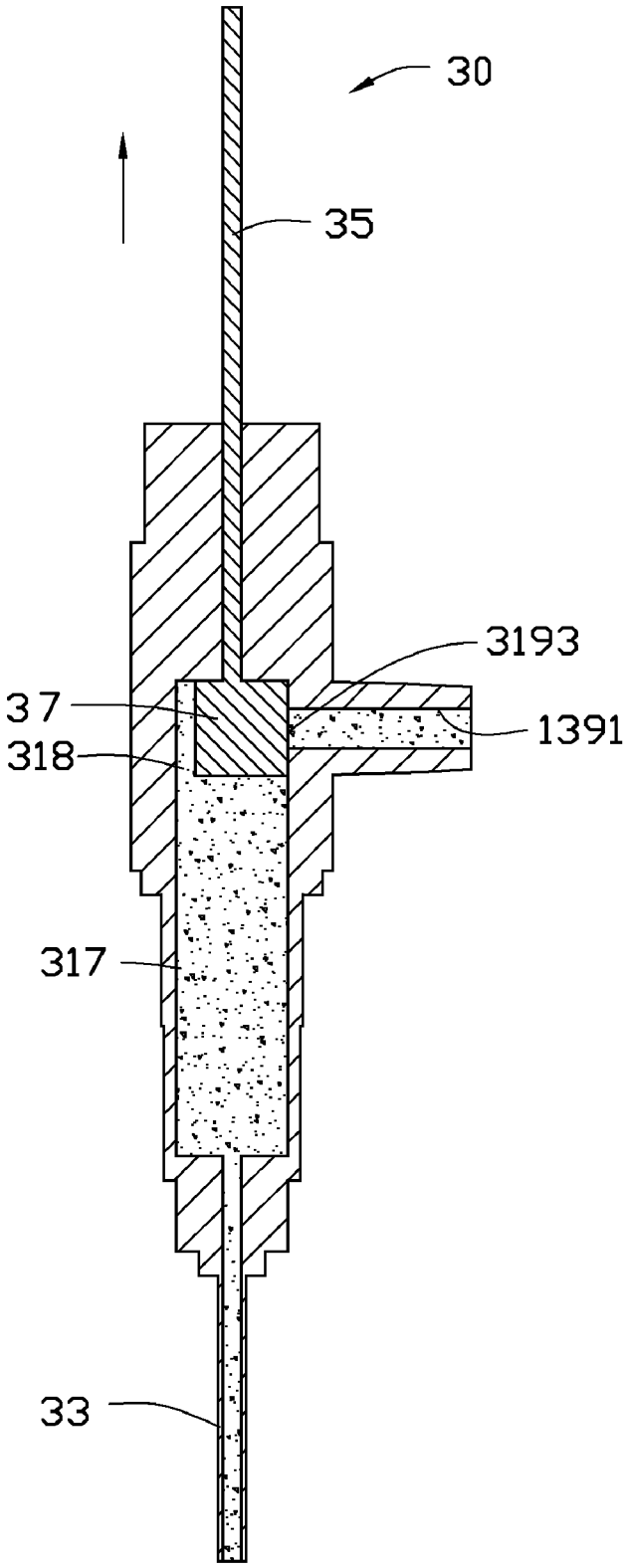
FIG. 8 is similar to FIG. 7, but shows the valve plug in another position.

Referring to FIG. 8, when the dispenser 30 is to be turned off (closed state), the actuating shaft 35 is moved immediately upward, such that the valve plug 37 moves away from the nozzle 33 and seals the inlet opening 3193. The dispenser 30 can easily return to the on/open state again by moving the valve plug 37 to be near the nozzle 33 to open the inlet opening 3193.

It is to be understood that the configurations of the first fastening member 55, the second fastening member 85, and the third fastening member 90 are not limited to those described in the embodiments, for example, they can also be pins. The first fastening member 55 and the second fastening member 85 can be omitted, as long as the two ends of the dispenser 10 can be latched or fixed to the first fixing member 50 and the second fixing member 70, respectively. If the replacement of the dispenser 10 is not desired, the first fixing member 50 and second fixing member 70 can also be omitted. The driving device 23 and the supporting member 60 can further be omitted, as long as the actuating shaft 15 is driven manually, and the dispenser 10 is fixed to the mounting plate 20 by other means such as fasteners.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A dispensing apparatus, comprising:

a mounting plate;

a dispenser fixed to the mounting plate, the dispenser comprising:

a nozzle valve, the nozzle valve comprising a cavity defined therein to contain a material, and an inlet opening defined in a sidewall thereof to communicate with the cavity;

a valve plug disposed inside the cavity;

an actuating shaft extending through an end of the nozzle valve, and connected to the valve plug; and a nozzle disposed at the other end of the nozzle valve opposite to the actuating shaft;

wherein the actuating shaft moves the valve plug away from or closer to the nozzle so as to close or open the inlet opening, respectively.

2. The dispensing apparatus of claim 1, wherein the valve plug is substantially conical, and has an increasing width towards the nozzle; the cavity comprises a first receiving portion having a shape similar to the valve plug and a second receiving portion communicating with the first receiving portion; the inlet opening communicates with the first receiving portion; and a gap is defined between the valve plug and a sidewall of the second receiving portion.

3. The dispensing apparatus of claim 1, wherein the valve plug is substantially cylindrical, and the cavity is substantially cylindrical with a circumference exceeding that of the valve plug; a side surface of the valve plug facing the inlet opening contacts a sidewall of the cavity; and a gap is defined between the valve plug and the cavity.

4. The dispensing apparatus of claim 1, further comprising a driving device fixed to the mounting plate, wherein the actuating shaft is connected to and driven by the driving device.

5. The dispensing apparatus of claim 4, wherein the driving device comprises a cylinder body and a piston shaft, the piston shaft is movably connected to the cylinder body, and the dispensing apparatus further comprises a connecting sleeve interconnecting the piston shaft and the actuating shaft.

6. The dispensing apparatus of claim 5, wherein the connecting sleeve defines a first latching cavity to receive the piston shaft and a second latching cavity communicating with the first latching cavity to receive the actuating shaft.

7. The dispensing apparatus of claim 6, wherein the connecting sleeve further defines a threaded hole thereof communicating with the second latching cavity; the dispensing apparatus further comprises a second fastening member comprising a threaded portion received in the threaded hole and abutting the actuating shaft.

8. The dispensing apparatus of claim 4, further comprising a supporting member fixed to the mounting plate and a second fixing member fixed to the supporting member, wherein the driving device is fixed to the supporting member, and the second fixing member defines a through hole to receive the dispenser.

9. The dispensing apparatus of claim 8, further comprises a third fastening member comprising a threaded portion; the mounting plate defines a latching groove thereof; the supporting member defines a threaded hole thereof; the threaded portion of the third fastening member passes through the latching groove of the mounting plate and is received in the threaded hole of the supporting member, so as to fix the supporting member to the mounting plate.

10. A dispensing apparatus, comprising:

a mounting plate;

a dispenser fixed to the mounting plate, the dispenser comprising:

a nozzle valve, the nozzle valve comprising a cavity defined therein to contain a material, and an inlet opening defined in a sidewall thereof to communicate with the cavity;

a valve plug disposed inside the cavity;

an actuating shaft extending through an end of the nozzle valve, and connected to the valve plug;

a nozzle disposed at the other end of the nozzle valve opposite to the actuating shaft; and a first fixing member and a nozzle sleeve fixed to the mounting plate; the first fixing member defining a through hole to receive the nozzle and the dispenser, and the nozzle through the nozzle sleeve, wherein the actuating shaft moves the valve plug away from or closer to the nozzle so as to close or open the inlet opening, respectively.

11. The dispensing apparatus of claim 10, wherein the through hole comprises a first holding portion to receive the nozzle valve, and a second holding portion communicating with the first holding portion to receive the nozzle sleeve.

12. The dispensing apparatus of claim 11, wherein the first fixing member further defines a threaded hole on a side surface thereof communicating with the first holding portion; the dispensing apparatus further comprises a first fastening member comprising a threaded portion received in the threaded hole and abutting the nozzle valve of the dispenser.

* * * * *